US005088617A

United States Patent [19]

Williams et al.

[11] Patent Number: 5,088,617

[45] Date of Patent: Feb. 18, 1992

[54] PACKAGE FOR FOOD PRODUCTS

[75] Inventors: Roger S. Williams, Calhoun, Ga.; Lee Kramer, Germantown, Tenn.

[73] Assignee: Sara Lee Corporation, Winston-Salem, N.C.

[21] Appl. No.: 661,608

[22] Filed: Feb. 28, 1991

[51] Int. Cl.[5] ..... B65D 5/54

[52] U.S. Cl. ..... 220/403; 229/40; 229/87.05; 229/87.11; 206/831; 426/123; 426/129

[58] Field of Search ..... 229/87.11, 40, 87.05; 206/831; 426/123, 129; 220/403

[56] References Cited

U.S. PATENT DOCUMENTS

| | | | |
|---|---|---|---|
| 1,933,516 | 10/1933 | Rosen | 229/40 |
| 2,888,352 | 5/1959 | Estes | 229/87.11 |
| 3,343,661 | 9/1967 | Nugarus | 426/129 |
| 4,108,350 | 8/1978 | Forbes, Jr. | 206/831 |
| 4,116,378 | 9/1978 | Bell et al. | 229/40 |
| 4,453,628 | 6/1984 | Walter | 229/87.11 |
| 5,014,856 | 5/1991 | Griesbach et al. | 426/129 |
| 5,026,563 | 6/1991 | Van Erden et al. | 426/123 |

*Primary Examiner*—Stephen P. Garbe

[57] ABSTRACT

A package for food products which includes, in combination, a clear container having recloseable means for retaining the food product until it is consumed, and a unitary blank folded to envelope the container which is configured to have first and second ends, securing means to attach the first and second ends to each other thereby resulting in the blank enveloping the clear product carrying container, separating means enabling the opening of the unitary blank, a detachable label secured to the clear container which tears away from the unitary blank when it is opened by the actuation of the separating means, and a window positioned to permitt viewing by the consumer of the recloseable means of the clear container.

12 Claims, 2 Drawing Sheets

PACKAGE FOR FOOD PRODUCTS

BACKGROUND OF THE INVENTION

1. Field of the Invention

The field of technology to which the invention pertains is the field of packaging, and more particularly, to combination element packages which may be opened and reclosed thus providing considerable convenience to the consumer.

2. Description of the Prior Art

Flexible bag-like recloseable packages which have an inner, hermetic seal and an outer reclosure seal are presently known for packaging various food products such as wieners, bacon, sliced luncheon meats, chops, cheese and the like. Other flexible plastic packages utilizing zip-like closure means are also known, however, these have no defined or consistent exterior shape and cannot be attractively decorated or shelf marketed in an appealing manner. A number of blister type food product packages also incorporates reclosing elements which function to reclose the package and protect the remaining portion of the food product when the blister is pushed against the supporting base. Unfortunately, this type of reclosure component has not been generally effective or reliable because it is usually most difficult to get a complete resealing of the package from the reclosure operation.

SUMMARY OF THE INVENTION

The present invention is a package for food products which includes in combination a clear container having recloseable means to allow access to the food product inside the package and reseal the package to preserve the remainder of the food product not consumed, and a blank enveloping the clear container which has first and second ends, means to attach the first and second ends to each other, separating means to enable reopening of the closed unitary blank and access to the clear plastic container, a detachable label secured to the clear container so that it remains therewith when the blank is opened and removed, and a window positioned to permit viewing the recloseable means of the clear container.

The blank is folded to form a rectangular package which can be attractively decorated, efficiently stacked and shelf-marketed, and provided with an appropriate opening to permit viewing of the products held in the clear container and the recloseable means of the container.

Additional advantages of the present invention, both as to its construction and mode of operation, will be readily appreciated as they become better understood by reference to the following detailed description when considered in connection with the accompanying drawings in which like reference numerals indicate like parts throughout the figures.

DESCRIPTION OF THE PREFERRED EMBODIMENTS

Figure 1:
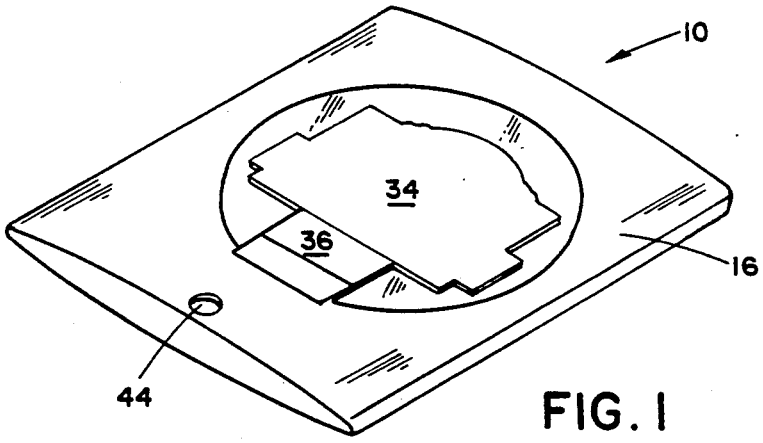
FIG. 1 is a perspective view of the primary embodiment of the food product package comprising the present invention.

Referring now to the drawings and particularly to FIG. 1, the food product package shown generally as 10 is formed from two essential components. The first component is a clear container 12 which has a recloseable element 14. Container 12 is usually formed from a soft flexible plastic material which is suitable to receive products of various configurations. The second component is preferably one-piece usually paperboard blank 16 which is suitably creased and scored to permit precise folding so that it can envelope the soft clear plastic food product container 12. The blank has first and second ends 18,20 on which are positioned suitable securing means, for example, glue beads 22, that function to secure the first blank end to the second blank end and hold it about the clear plastic food product container 12.

Blank 16 has a top edge 24 from which extends a top tab 26. Similarly, the blank bottom edge 28 supports a bottom tab 30. A display area 32 permits viewing the contents of the soft clear plastic food product container 12 when the food products package 10 is on display. A detachable label 34 is a part of blank 16 by virtue of the connecting element 36 and is preferably secured to the surface of the clear plastic food product container 12. The function of label 34 with respect to the clear plastic container 12 and the one-piece blank 16 will be described subsequently.

Separation means for the one-piece blank is shown in the present embodiment as a tear strip 38, and its operation and effect on the food products package will also be described subsequently. A viewing window 40 is strategically positioned to permit inspection of the recloseable means 14 by a prospective purchaser to ensure that the purchaser is aware of the reclosing capabilities.

Figure 2:
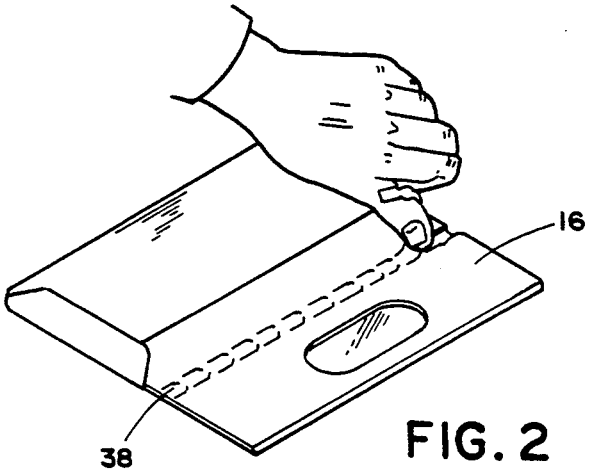
FIG. 2 is a perspective view of the actuation of the blank separating means of the food product package comprising the present invention.
Figure 4:
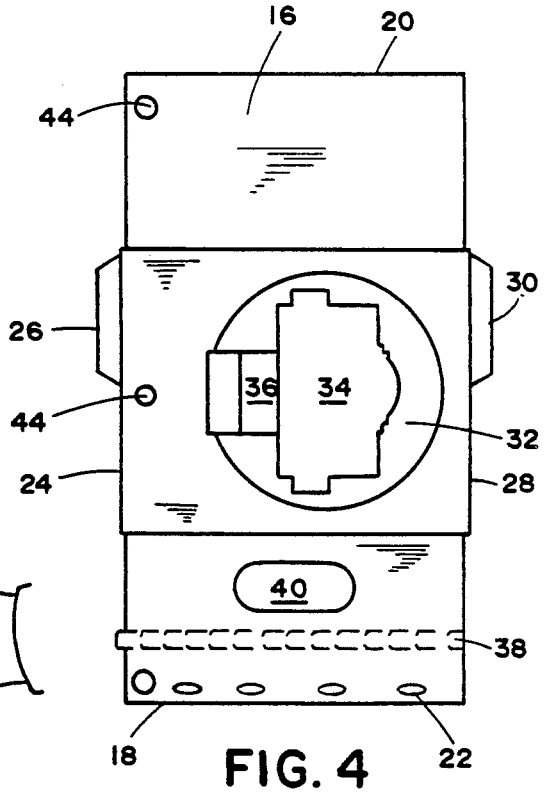
FIG. 4 is a plan view of the blank of the primary embodiment of the food products package comprising the present invention showing the joinable ends, the separating means, in this case a tear strip, the top and bottom tabs and the detachable label.
Figure 3:
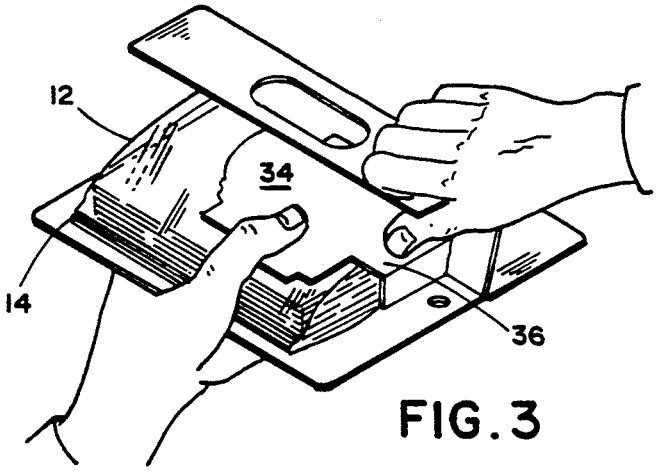
FIG. 3 is a perspective view of the separated blank of the food product package comprising the present invention showing the detachable label remaining secured to the clear container as the blank is removed.
Figure 5:
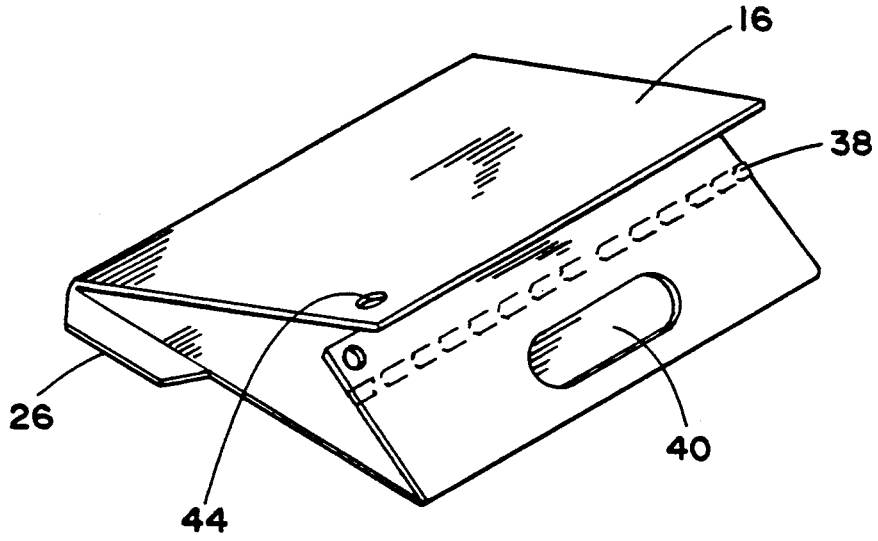
FIG. 5 is a perspective view of the partially folded blank showing the folded configuration of the blank of the present invention.

When the package is to be opened, tear strip 38 is grasped and pulled to open the one-piece blank and release the soft clear plastic food product container and its contents from its enveloped position as shown in FIGS. 2 and 3. Because the detachable label 34 is firmly secured by an aggressive glue to the soft clear plastic food product container 12, it separates from blank 16 at connecting element 36 when the blank is opened through the actuation of the tear strip 38 thereby remaining as a permanent label with the soft clear plastic food product container so long as that container continues to be used to house its food contents. Blank 16 can be discarded and preferably recycled once it has been opened by the actuation of tear strip 38.

The top and bottom tabs 26, 30 fold downwardly over the first and second connected ends 18, 20 (FIG. 1) to further secure the blank 16 in an enveloping configuration around the clear plastic container 12. The food package 10 can be case-, counter- or shelf-stacked for marketability in retail outlets or be pegboard mounted for consumer display by the provision of an aperture 42.

Package 10 in its marketed form provides an additional measure of protection to the food product it contains in that the soft clear plastic food product container is overlaid with the enveloping one-piece blank, usually made of paperboard. Obviously, numerous other materials such as plastic, film and the like may be utilized to form it. Moreover, the one-piece blank can be attractively decorated to enhance its marketability and provide a more upscale final package than would be possible if utilizing only a soft clear plastic food product container with stickered information and decoration.

While a preferred embodiment of the invention has been described and illustrated, it will be understood that modification may be resorted to within the scope of the appended claims.

I claim:

1. A package for food products comprising: a clear container having openable and resealable means; a unitary blank enveloping the clear container, the paperboard blank having first and second ends, securing means to attach the first and second ends to each other, separating means enabling the opening of the unitary blank, a detachable label secured to the clear container, separating means enabling the opening of the unitary blank, and a window positioned to permit viewing the openable and resealable means of the clear container.

2. The package as claimed in claim 1 wherein the paperboard blank securing means is one or more glue beads.

3. The package as claimed in claim 2 wherein the clear container is a soft plastic pouch.

4. The package as claimed in claim 2 wherein the window position is located nearer one paperboard blank end than the other.

5. The package as claimed in claim 4 wherein the separating means is a tear strip.

6. The package as claimed in claim 1 wherein the window position is located nearer one paperboard blank end than the other.

7. The package as claimed in claim 6 wherein the clean container is a soft plastic pouch.

8. The package as claimed in claim 1 wherein the separating means is a tear strip.

9. The package as claimed in claim 1 wherein the clear container is a soft plastic pouch.

10. A package for food products comprising: a clear plastic food product container having openable and recloseable means; a paperboard one-piece blank enveloping the clear plastic food product container, the paperboard one-piece blank having first and second ends and top and bottom edges, randomly positioned glue beads enabling the securement of the first paperboard blank end to the second paperboard blank end, a detachable label secured to the clear plastic food product container, separating means to open the one piece blank and thereby free the clear plastic food product container, and a window suitably positioned to permit viewing of the reopenable and recloseable means of the clear plastic food product container.

11. A package for food products comprising: a soft clear plastic food product container having openable and closeable means; a one-piece paperboard blank enveloping the soft clear plastic food product container, the one-piece blank having first and second ends and top and bottom edges, selectively positioned glue beads located proximate one of the one-piece blank ends enabling the securement of the first one-piece blank end to the second one-piece blank end and the envelopment of the one-piece blank about the soft clear plastic food product container, a top tab extending from the one-piece blank top edge, a bottom tab extending from the one-piece blank bottom edge, a display area exposing the contents of the soft clear plastic food product container, a detachable label extending into the display area and secured to the soft clear plastic food product container, one piece blank separation means enabling the opening of the one piece blank to release the soft clear plastic food product container from its enveloped position, and a viewing window positioned to permit inspection of the soft clear plastic food product container openable and closeable means whereby the enveloped soft clear plastic food product container is released when the one-piece blank separation means is activated, the detachable label is detached from the one-piece blank and remains secured to the soft clear plastic food product container, the one-piece blank is discarded, and the soft clear plastic food product container is available for continued opening and closing use until its food products are exhausted.

12. The package as claimed in claim 11 wherein the one-piece blank is foldable to envelope the soft clear plastic food product container and the top and bottom tabs are moveably positionable to hold the one-piece blank in the enveloping arrangement about the soft clear plastic food product container.

* * * * *